United States Patent [19]

Konyak et al.

[11] 4,067,549

[45] Jan. 10, 1978

[54] CERAMIC RAPPER ROD ASSEMBLY

[75] Inventors: John Francis Konyak, Flemington; Edrol Ford Troxtel, Frenchtown, both of N.J.; George Mundy Schuman, Jr., Kintnersville, Pa.; Andrew Hugh Maguire, Flemington; Elwin Arthur Guthrie, Lebanon, both of N.J.

[73] Assignee: Plessey Incorporated, Melville, N.Y.

[21] Appl. No.: 723,138

[22] Filed: Sept. 14, 1976

[51] Int. Cl.[2] ..... B03C 3/76

[52] U.S. Cl. ..... 74/579 R; 173/131; 55/112; 366/108

[58] Field of Search ..... 55/112, 299, 304, 428, 55/430; 259/1 R, DIG. 42; 425/432, 456; 173/126, 127, 131; 198/766; 74/1 SS

[56] References Cited

U.S. PATENT DOCUMENTS

| | | | |
|---|---|---|---|
| 3,605,915 | 9/1971 | Gately et al. | 55/112 |
| 3,731,907 | 5/1973 | Lash | 259/1 R |
| 3,771,769 | 11/1973 | Niemi et al. | 425/432 |
| 3,945,613 | 3/1976 | Jysky et al. | 55/112 |

FOREIGN PATENT DOCUMENTS

| | | | |
|---|---|---|---|
| 1,300,592 | 6/1962 | France | 55/304 |

*Primary Examiner*—Frank W. Lutter
*Assistant Examiner*—David L. Lacey
*Attorney, Agent, or Firm*—James J. Burke

[57] ABSTRACT

Electrostatic precipitators and other devices requiring vibration may be required to operate in high temperature environments, have a high dielectric strength, and withstand impacts that range into thousands of foot-pounds per second at a high repetition rate. In the present invention, a transmission or rapper rod is employed including tapered ends, that are too short to bottom in the corresponding mounting sleeves, and further including a pair of thin, malleable metallic shims between the tapered ends and the sleeves acting to accommodate dimensional tolerances and distinct surface finishes, thereby eliminating fracture-inducing impacts.

6 Claims, 2 Drawing Figures

CERAMIC RAPPER ROD ASSEMBLY

BACKGROUND OF THE INVENTION

The present invention relates, in general, to vibrator systems and, more particularly, to assemblies for transmitting vibratory motion to a device, such as an electrostatic precipitator, under temperature conditions that may be as high as 800° F.

Pneumatic vibrators are widely used in industry to facilitate movement of bulk materials through bins and hoppers, deslagging boilers, and in electrostatic precipitators, to knock accumulated dusts off the collecting plates therein. The piston-driven vibrator terminates in a sleeve having a tapered bore, into which a transmission pin fits, which is variously called a precipitator pin or a rapper rod. This pin is tapered at both ends to fit into the vibrator sleeve and a similar sleeve and housing on the anvil holding the precipitator plates.

To achieve electrical isolation, the rapper rod must be a good insulator, an ability to withstand electrical charge of 60,000 volts DC being a typical specification.

The rapper rod must have a high mechanical strength; rapping rates can vary from 1500 to over 2500 impacts per minute, and the inner impact power, in foot-pounds per second, can vary from 5 to over 3,000.

More recently, these rigorous specifications have been further complicated by the desire of utilities, and other industrial concerns to operate precipitators at very high temperatures, up to 800° F., mainly to get good dispersion of cleaned stack gases and avoid condensation, and also avoid the expensive reheating that is required if the gases are scrubbed at lower temperatures.

Metal rods are of course ruled out by the electrical requirements. Rods fabricated from fiber-glass impregnated melamine plastic have been employed with success, but only on units operating below about 300° F., above which that material loses its mechanical strngth.

For applications at very high temperatures, ceramics are an obvious material of choice, but great difficulty with fracture has been experienced even with tapered sleeves and housings, wherein the impact energy is absorbed over a much larger surface area than would be the case with simple end-rapping.

A further problem has been the need to retro-fit existing precipitator installations for high temperature operation with impact-resistant ceramic rapper rods where machining of sleeves or the like is not possible.

Not all vibrator assemblies include tapered sleeves, which are essential for the present invention; one line that does is produced by National Air Vibrator Co. under their "Rapper-3" brand, and is described in U.S. Pat. No. 3,731,907.

OBJECTS OF THE INVENTION

A general object of the present invention is to provide an improved rapper rod assembly for duty in high temperature environments.

Another object of the present invention is to provide a ceramic rapper rod assembly able to withstand high impact energy loads without fracture.

A further object of the present invention is to provide a ceramic rapper rod assembly that can be readily installed in existing vibrator systems without machining or other field alterations.

Various other objects and advantages of the invention will become clear from the following description of the embodiments thereof, and the novel features will be particularly pointed out in connection with the appended claim.

THE DRAWINGS

Reference will hereinafter be made to the accompanying drawings, wherein:

FIG. 1 is a side elevation view, partly in section, of an embodiment of the invention; and FIG. 2 is a perspective view of a shim for use in the FIG. 1 embodiment.

DESCRIPTION OF EMBODIMENTS

The present invention is based, at least in part, on the realization that even with the most careful quality control, the fracture of tapered ceramic rapper rods must have been occasioned by either a dimensionally imperfect mating of the tapered rod end and the corresponding sleeve, and/or the inherently different surfaces of the sleeve, usually stainless steel, and the ceramic. Because of either of these causes, rather than having a large uniform surface over which the impact energy is transmitted, it is in fact transmitted through a plurality of point, line, or small area contacts. The impact energy in any given application is constant, but with the aforesaid reduction in available surface for transmission, and its uneven application over the surface of the taper, the compressive strength of the ceramic is readily exceeded and fracture ensues.

This and the other problems as aforesaid are overcome by (1) using a high strength alumina ceramic, (2) shortening the rod so that it does not bottom in either sleeve, and (3) most important, providing a malleable metal shim, in the form of a tapered sleeve that substantially but not entirely surrounds the tapered rod end, between the latter and the sleeve.

Figure 1:
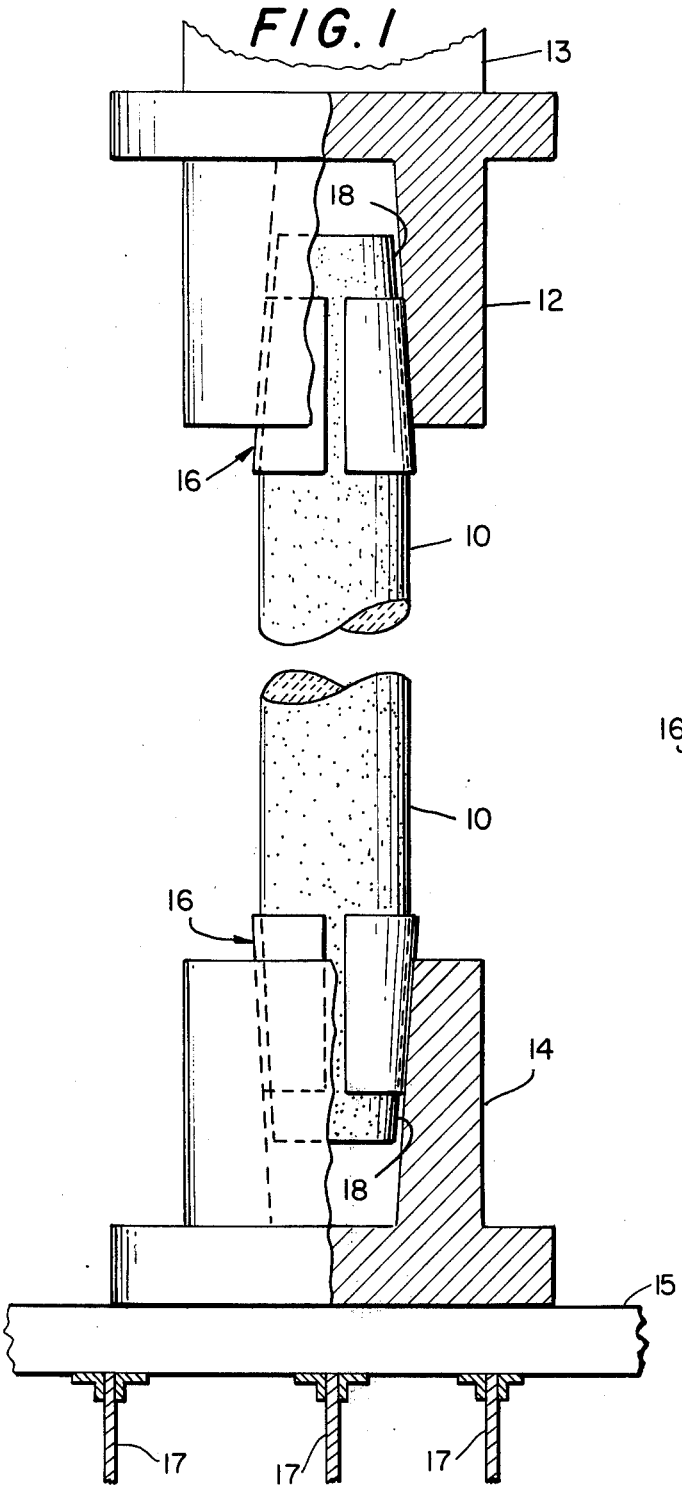

With reference to FIG. 1, a ceramic rapper rod 10 is shown as fitting into the tapered bores of an upper sleeve housing 12 and a lower sleeve housing 14, but sized lengthwise so as not to bottom in either. In a precipitator installation, housing 12 would be operatively connected to the piston 13 of the vibrator unit, and housing 14 would be attached to the anvil 15 holding a number of precipitator plates 17. The rod 10 will also typically pass through appropriate seals, also not shown.

Typical dimensions for rod 10 are 36 inches length, 2 inches O.D., and 3 inches tapered sections at each end at a taper of 3°-30′.

While it is not a necessary feature of the invention except in rods for particularly rigorous applications, the use of a high strength ceramic is preferred, particularly since cost differentials between these and ordinary ceramics are not great. One such ceramic is described and claimed in U.S. Pat. No. 3,291,619, assigned to a predecessor company of the assignee of the instant application, and has the following composition:

| | Weight Percent Range |
|---|---|
| $Al_2O_3$ | 68.5 - 98.5 |
| $SiO_2$ | 0.5 - 30.0 |
| MnO | 0.5 - 30.5 |
| $TiO_2$ | 0.5 - 8.0 |

Such ceramics are typically fired at a peak of 2700° F. over a 36 hour period, will have a surface resistivity in the range of $10^{10}$–$10^{13}$ ohms/cm$^2$, a dielectric constant of 9, and a modulus of rupture on the order of 50,000 psi.

Another suitable composition, though not having as high a rupture strength, includes 80–90% $Al_2O_3$, 5–10% $MnO_2$, 0–5% bone ash and 5% ball clay. The latter includes small amounts of alkaline earth oxides which are deemed beneficial.

Figure 2:
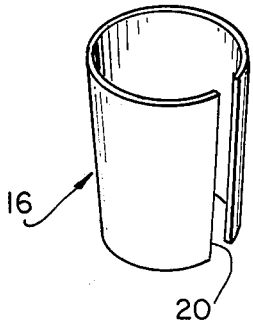

Referring again to the drawing, the most important single feature of the invention is the tapered cylindrical shim 16, shown installed in FIG. 1 and in a perspective view in FIG. 2. Shim 16 is fabricated from a suitable malleable metal, such as aluminum, and is dimensioned so as to substantially but not entirely surround the tapered ends 18 of the rod 10. The open slot 20 in shim 16, which may typically be about one-eigth inch wide, allows it to thermally expand without buckling or otherwise impairing contact between the sleeves and the rod. Shim 16 may be fabricated from sheet stock such as aluminum flashing having a thickness of the order of 10 or 15 thousandths of an inch. Other metals may be employed, but account must be taken of both the thermal and chemical environments in which one of each pair of shims will be employed, lest corrosion become a maintenance problem.

While not wishing to be bound to any particular theory for the success of the invention, it is believed that the malleable metal of the shim is deformed to conform precisely with the sleeve surface and the tapered ends 18, thereby achieving the maximum available surface area for transmission of impact energy, and elimination of point, line or small area contacts. While rapper rod assemblies employing the invention have not been observed to fracture at either end, it is further to be noted that the thermal environment at the high temperature end may well be within the hot-working temperature range of the shim metal, thus increasing its malleability, in accordance with known principles.

As those skilled in the art will appreciate, the use of shims as aforesaid allows the retro-fit of ceramic rappers into existing installations without the need for machining, etc., thus increasing their temperature ratings.

Various changes in the details, steps, materials, and arrangements of parts, which have been herein described and illustrated in order to explain the nature of the invention, may be made by those skilled in the art within the principle and scope of the invention as defined in the appended claims.

What is claimed is:

1. An assembly for transmitting vibratory motion from a source to a structure comprising:

a pair of coaxial mounting sleeves mounted on said respective source and structure and including tapered bores;

a ceramic rod having tapered end portions matching the taper of said bores and mounted therein, said rod being of insufficient length to bottom in either bore; and a pair of thin, malleable metal shims substantially but not entirely surrounding each said tapered end portion, between said end portion and said bore.

2. The assembly as claimed in claim 1, wherein said rod is a high alumina, high strength ceramic.

3. The assembly as claimed in claim 2, wherein said ceramic has a composition falling within the following ranges:

| | Wt. Pct. |
|---|---|
| $Al_2O_3$ | 68.5 – 98.5 |
| $SiO_2$ | 0.5 – 30.0 |
| MnO | 0.5 – 30.5 |
| $TiO_2$ | 0.5 – 8.0 |

4. The assembly as claimed in claim 1, wherein said tapers are between 3 ° and 4°.

5. The assembly as claimed in claim 1, wherein said malleable metal is aluminum.

6. The assembly as claimed in claim 1, wherein said structure is an anvil for an electrostatic precipitator.

* * * * *